US009309653B2

(12) United States Patent
Hyde et al.

(10) Patent No.: US 9,309,653 B2
(45) Date of Patent: Apr. 12, 2016

(54) SYSTEMS AND METHODS FOR GATHERING WATER

(71) Applicant: Elwha LLC, Bellevue, WA (US)

(72) Inventors: Roderick A. Hyde, Redmond, WA (US); Robert C. Petroski, Seattle, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 14/109,501

(22) Filed: Dec. 17, 2013

(65) Prior Publication Data

US 2015/0167267 A1 Jun. 18, 2015

(51) Int. Cl.
*E02B 11/00* (2006.01)
*E03B 3/06* (2006.01)

(52) U.S. Cl.
CPC ..... *E03B 3/06* (2013.01)

(58) Field of Classification Search
CPC ..... E02D 31/02; E02B 11/00; E02B 11/005
USPC ..... 137/236.1; 405/45; 47/79–83, 48.5
See application file for complete search history.

(56) References Cited

U.S. PATENT DOCUMENTS

| | | | | |
|---|---|---|---|---|
| 3,958,366 | A * | 5/1976 | Meyers | 47/81 |
| 4,411,555 | A * | 10/1983 | Minvielle et al. | 405/50 |
| 4,574,541 | A * | 3/1986 | Raidt et al. | 52/169.5 |
| 4,759,227 | A | 7/1988 | Timmons | |
| 4,904,113 | A * | 2/1990 | Goddard et al. | 405/45 |
| 4,943,185 | A * | 7/1990 | McGuckin et al. | 405/45 |
| 4,956,951 | A * | 9/1990 | Kannankeril | 52/169.5 |
| 5,056,281 | A * | 10/1991 | McCarthy | 52/169.5 |
| 5,911,540 | A * | 6/1999 | Adamson | 405/43 |
| 6,672,016 | B2 * | 1/2004 | Janesky | 52/169.5 |
| 6,684,579 | B2 * | 2/2004 | Brunson et al. | 52/169.5 |
| 6,691,472 | B2 * | 2/2004 | Hubert | 52/169.5 |
| 6,733,209 | B2 * | 5/2004 | Allard | 405/302.6 |
| 6,802,668 | B2 * | 10/2004 | Parker | 405/49 |
| 6,817,811 | B1 | 11/2004 | Chen | |
| 2010/0200512 | A1 | 8/2010 | Chase et al. | |
| 2012/0230767 | A1 * | 9/2012 | desGarennes et al. | 405/45 |

FOREIGN PATENT DOCUMENTS

| | | | |
|---|---|---|---|
| JP | 2011-131464 | A | 5/1991 |
| JP | 2007-004534 | U | 1/1995 |
| KR | 10-1037952 | B1 | 5/2011 |

OTHER PUBLICATIONS

PCT International Search Report; International App. No. PCT/US2014/069814; Mar. 20, 2015; pp. 1-5.

* cited by examiner

*Primary Examiner* — Tara M. Pinnock
(74) *Attorney, Agent, or Firm* — Foley & Lardner LLP

(57) ABSTRACT

A conduit system for gathering water from soil includes multiple conduits configured for insertion into soil. Each conduit includes a wall having an outer surface configured to be exposed to soil and an inner surface defining a central passage. The wall includes multiple gathering pores extending through the wall. The cross-sectional area of each gathering pore decreases from the outer surface to the inner surface to promote capillary action for moving water from the soil through each gathering pore to the central passage.

31 Claims, 8 Drawing Sheets

SYSTEMS AND METHODS FOR GATHERING WATER

BACKGROUND

Soil encompasses loose materials, which may include sand, silt, clay, organic matter, rocks and minerals of various sizes, gravel, humus, volcanic ash, regolith, and mixtures thereof. Soil is found on the Earth and may also be used as growth media in above-ground planting beds or other containers of various sizes (e.g., in a greenhouse). Soil also contains gases in the voids between the loose materials. Soil may also contain relatively large amounts of water by volume. Damp soil can be about 40% water by volume and even seemingly dry soil can be about 15% water by volume.

SUMMARY

One embodiment relates to a conduit system for gathering water from soil including multiple conduits configured for insertion into soil. Each conduit includes a wall having an outer surface configured to be exposed to soil and an inner surface defining a central passage. The wall includes multiple gathering pores extending through the wall. The cross-sectional area of each gathering pore decreases from the outer surface to the inner surface to promote capillary action for moving water from the soil through each gathering pore to the central passage.

Another embodiment relates to a method of gathering water from soil including inserting multiple conduits into soil, gathering water into the conduits through multiple gathering pores that promote capillary action, and transporting the gathered water through the conduits.

Another embodiment relates to a conduit system for gathering water from soil including multiple conduits configured for insertion into soil and a means for transporting the gathered water through each conduit. Each conduit includes a means for gathering water from soil through capillary action.

Another embodiment relates to a conduit system for gathering water from soil including multiple conduits configured for physical engagement with soil. Each conduit includes a wall having an outer surface configured to be engaged with soil and an inner surface defining a central passage. The wall includes multiple gathering pores extending through the wall. The cross-sectional area of each gathering pore decreases from the outer surface to the inner surface to promote capillary action for moving water from the soil through each gathering pore to the central passage.

Another embodiment relates to a method of gathering water from soil including physically engaging multiple conduits with soil, gathering water into the conduits through multiple gathering pores that promote capillary action, and transporting the gathered water through the conduits.

Another embodiment relates to a conduit system for gathering water from soil including multiple conduits configured for physically engaging soil and a means for transporting the gathered water through each conduit. Each conduit includes a means for gathering water from soil through capillary action.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
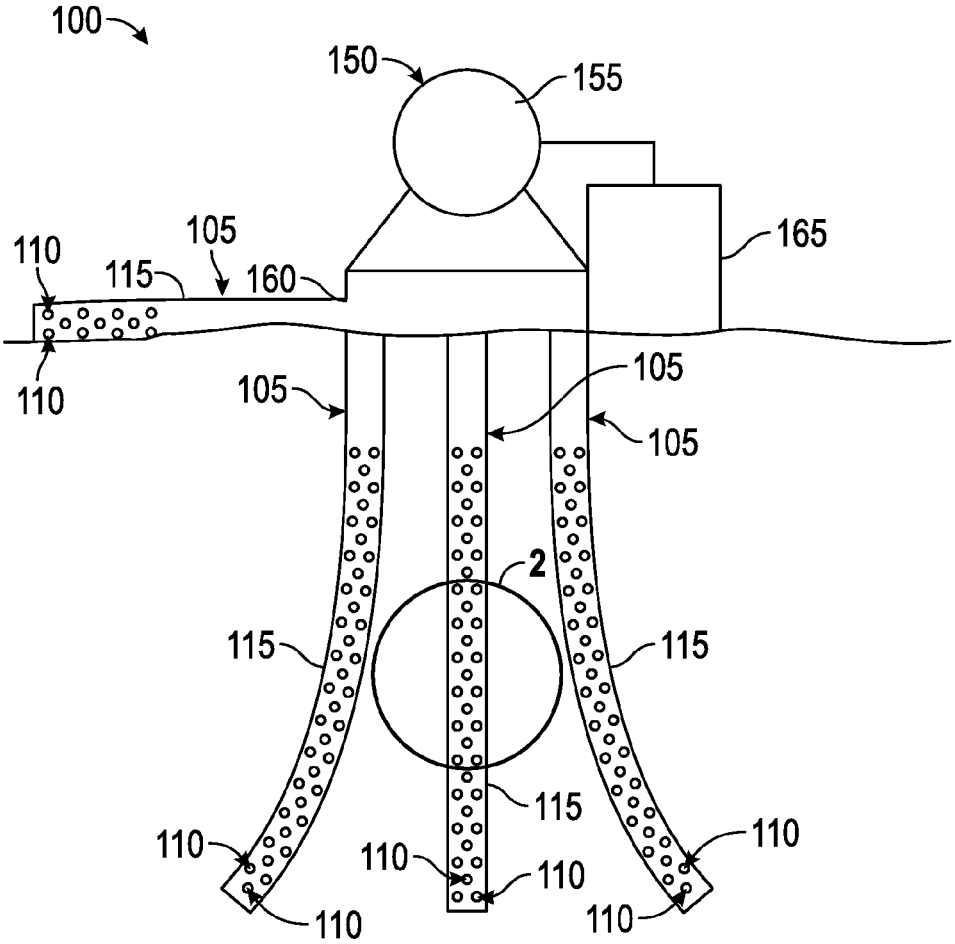
FIG. 1 is a schematic diagram of a system for gathering water from subsurface soil according to one embodiment.
Figure 2:
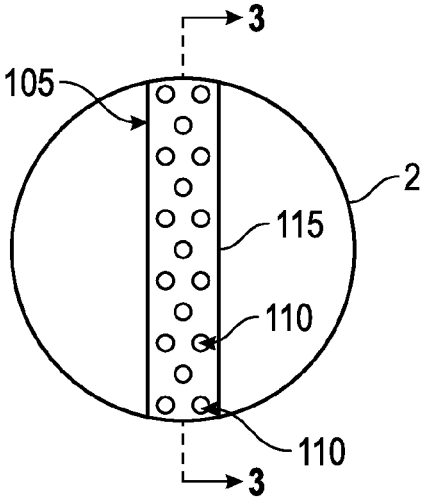
FIG. 2 is a detail view of the portion of the system of FIG. 1 within circle 2.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Systems for gathering water found in soil allow the gathered water to be used (e.g., for irrigation, drinking, cleaning, bathing, etc.). Some systems and methods described below make use of capillary action to gather water from soil.

Referring to FIG. 1, system 100 for gathering water from soil is illustrated according to one embodiment. System 100 includes multiple conduits 105. Each conduit 105 is manufactured from appropriate materials including plastics, metals, ceramics, etc. Conduits 105 are positioned to physically engage soil (e.g., extend below ground into soil and/or extend along the ground in physical contact with the soil). In some embodiments, conduits 105 are substantially rigid so that they may be inserted or driven into the soil with little or no excavation of soil. In some embodiments, conduits 105 are substantially flexible so that they may be freely arranged in the soil, which may require excavation of the soil (e.g., by hand, by machinery, etc.).

As shown in FIGS. 2 and 3A-3D, conduit 105 includes multiple gathering pores 110 that allow water in the subsurface soil to enter the conduit 105. Gathering pores 110 extend through a wall 115 of conduit 105. Wall 115 has an outer surface 120 exposed to the subsurface soil and an inner surface 125 that defines a central passage 130. Gathering pores 110 extend from outer surface 120 to inner surface 125. As shown in FIGS. 3A-3D, the cross-sectional area (e.g., diameter) of each gathering pore 110 decreases from outer surface 120 to inner surface 125. The decreasing cross-sectional area promotes capillary action for moving water from the subsurface soil through gathering pore 110 to central passage 130. The decreasing cross-sectional area creates a capillary gradient that draws water from the subsurface soil through gathering pore 110 to central passage 130.

Figure 3A:
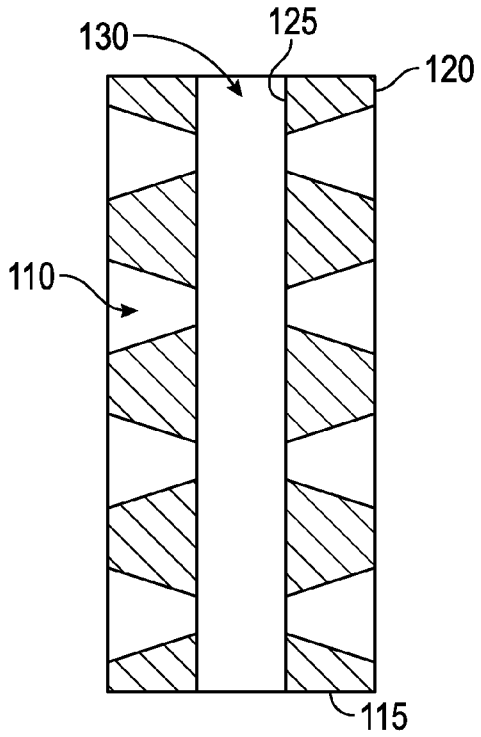
FIG. 3A is a cross-section view of the portion of the system of FIG. 2 along line 3-3, according to one embodiment.
Figure 3B:
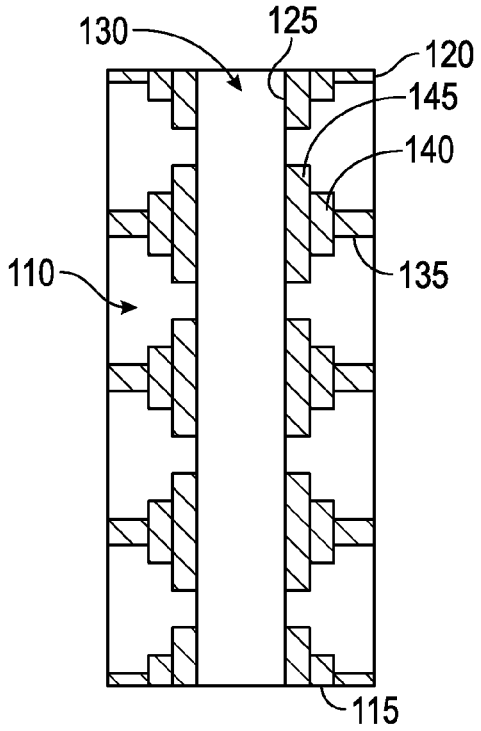
FIG. 3B is a cross-section view of the portion of the system of FIG. 2 along line 3-3, according to another embodiment.

The cross-sectional area of each gathering pore 110 can decrease in a variety of ways. As shown in FIG. 3A, the cross-sectional area of gathering pore 110 decreases continuously from outer surface 120 to inner surface 125. As shown in FIG. 3B, the cross-sectional area of gathering pore 110 decreases in a stepwise manner. As shown in FIG. 3B, conduit 105 is made up of multiple layers (e.g., layers 135, 140, and 145). In the outermost layer (e.g., layer 135), each gathering pore 110 has its largest cross-sectional area. In the innermost layer (e.g., layer 145), each gathering pore 110 has its smallest cross-sectional area. In any intermediate layers (e.g., layer 140), each gathering pore 110 has a cross-sectional area that is smaller than in the adjacent layer in the direction of outer surface 120 and larger than in the adjacent layer in the direction of inner surface 125. Conduits 105 function as an artificial root system, drawing water from subsurface soil in a manner similar to the root system of a plant. As shown in both FIGS. 3A and 3B, in some embodiments, the cross-sectional area of each gathering pore 110 decreases in size monotonically from outer surface 120 to inner surface 125.

In some embodiments, the cross-sectional area of gathering pore 110 is sized so that water moving through gathering pore 110 is filtered (e.g., purified). Sizing gathering pores 110 small enough prevents contaminants (e.g., bacteria, protozoa, microbial cysts, etc.) larger than gathering pore 110 from passing through gathering pore 110 into central passage 130. In this way, the water gathered by conduit 105 is filtered. In some embodiments, as shown in FIG. 3E, to facilitate filtering, the cross-sectional area of gathering pore 110 may decrease from a first value or size at the end of the gathering pore at outer surface 120 (i.e., the entrance to the gathering pore) to a minimum 112 (selected based on filtration requirements) partway along the length of the gathering pore (i.e. at an intermediate position between the two ends of the gathering pore), and then increase again to a second value or size at the end of the gathering pore at inner surface 125 (i.e., the exit from the gathering pore). The initial decrease in cross-sectional area from outer surface 120 to minimum 112 provides an effective capillary gradient to draw subsurface water into the gathering pore, allowing the exit cross-sectional area at inner surface 125 (e.g., a first size) to be, in some embodiments, substantially the same size (e.g., 80%, 90%, 95%, etc.) as the entrance cross-sectional area at outer surface 130 (e.g., a second size). In some embodiments, the minimum 112 is located at the exit of the gathering pore at inner surface 125. In some embodiments, gathering pores 110 are sized (i.e., their smallest cross-section is sized) to filter contaminants larger than 100 Angstroms. The size of the contaminants filtered by gathering pores 110 can be larger or smaller than 100 Angstroms.

As shown in FIG. 1, gathering pores 110 do not extend the full length of conduit 105. Rather, gathering pores 110 begin a distance away from the top end of conduit 105 so as not to gather water that is needed by the root systems of plants on the ground. Depending on the location in which the system 100 is used, this distance may vary. For example, in locations with grass cover, gathering pores 110 may begin at depths of between two and ten inches. In locations with plants having deeper root systems, this depth can increase (e.g., gathering pores 110 starting at depths of one foot or more).

In one embodiment, system 100 also includes pump 150. Pump 150 is fluidly coupled (i.e., in fluid communication with) conduits 105 via central passages 130 for moving water through conduits 105. Pump 150 includes pumping mechanism 155 (e.g., one or more pistons, diaphragms, screws, gears, plungers, impellers, etc.). Pumping mechanism 155 creates suction or a negative pressure in central passages 130. The negative pressure moves water through conduits 105 toward pump 150 and helps to move water through gathering pores 110. In some embodiments, as shown in FIG. 1, pump 150 includes inlet manifold 160 that fluidly couples central passages 130 to pumping mechanism 155. Pump 150 draws the water gathered by conduits 105 above ground and delivers the gathered water to container 165 (e.g., reservoir, storage volume, etc.) for use. In some embodiments, pump 150 delivers the gathered water at atmospheric pressure. The energy provided by pump 150 to draw the gathered water through conduits 105 to an elevated location provides sufficient potential energy to deliver the gathered water from conduits 105 or pump 150 without additional energy input from pump 150. The only energy cost associated with system 100 is that required for pump 150 to move the gathered water through conduits 105 (i.e., against gravitational and frictional heads). In some embodiments, pump 150 may be operated to move air backwards through conduits 105 and gathering pores 110 to clean gathering pores 110. Soil, contaminants, rocks, and other debris may accumulate in gathering pores 110. Operating pump 150, to move air through conduits 105, flushes this debris from gathering pores 110.

In some embodiments, system 100 can be portable. For example, portable system 100 could be mounted to or stored in a backpack or a carrying case. In some embodiments, system 100 is sized for individual or small group use (e.g., could be used by campers or hikers to provide drinking, cooking, or bathing water). In some embodiments, system 100 may be fixed to a specific location and sized to provide water, or supplement another water supply, for dwellings or other buildings in relatively dry locations (e.g., mountains, desert, etc.) or other areas where clean fresh water is not readily available (e.g., seaside, third-world countries, etc.). In some embodiments, system 100 includes conduits 105 of sufficient size and number to supply 0.1 to 1 cubic centimeters of water per second from a soil volume of about 10 cubic meters, although embodiments supplying other volumes can be designed and envisioned.

Figure 4:
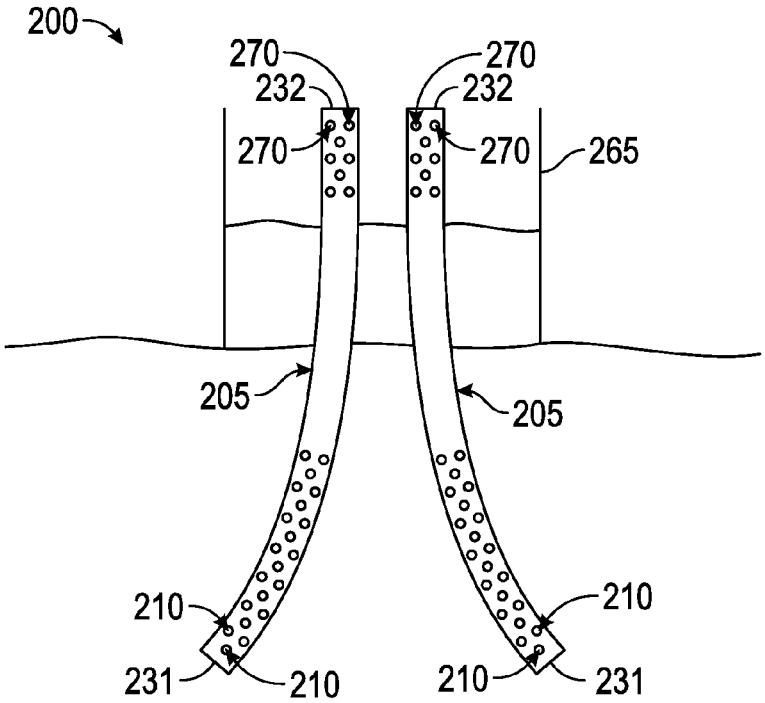
FIG. 4 is a schematic diagram of a system for gathering water from subsurface soil according to one embodiment.

Referring to FIG. 4, system 200 for gathering water from soil is illustrated according to one embodiment. System 200 is similar to system 100 and may include, in various embodiments, components similar to those described above with respect to system 100. Differences between system 200 and system 100 will be described in more detail below with components in system 200 similar to components in system 100 described by the same name and/or the same or similar reference number.

Figure 3C:
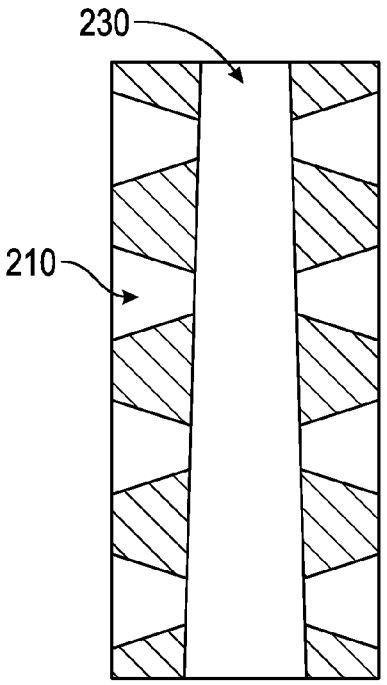
FIG. 3C is a cross-section view of the portion of the system of FIG. 2 along line 3-3, according to another embodiment.
Figure 3D:
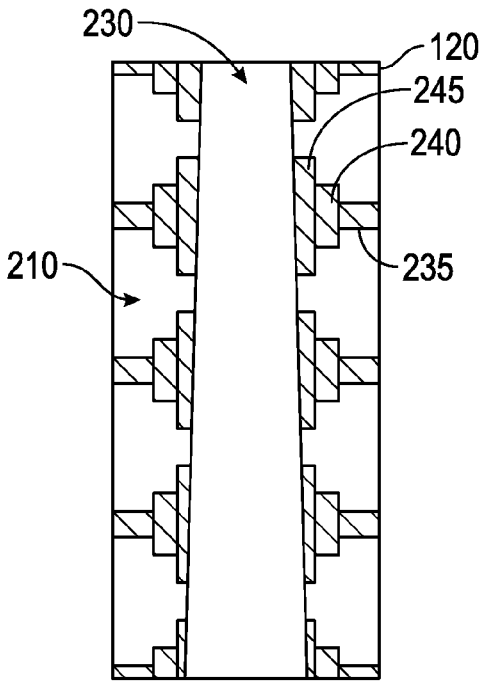
FIG. 3D is a cross-section view of the portion of the system of FIG. 2 along line 3-3, according to another embodiment.
Figure 3E:
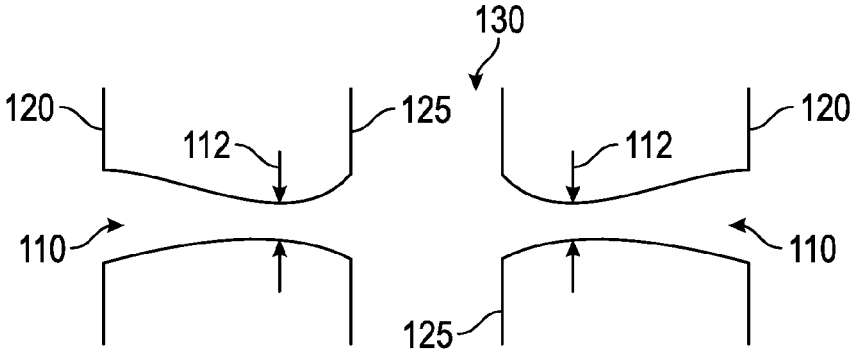
FIG. 3E is a cross-section view of a portion of the system of FIG. 2 along line 3-3, according to another embodiment.

As shown in FIGS. 3C and 3D, each conduit 205 of system 200 includes central passage 230 that decreases in cross-sectional area from a first region of the conduit (e.g., the region near end 231 of the conduit) to a second region of the conduit (e.g., the region near the other end 232 of the conduit). Similar to the gathering pores, the decreasing cross-sectional area of central passage 230 creates a capillary gradient and promotes capillary action for moving water from the first region to the second region. The capillary action is used to move water in central passage 230 from the first region (e.g., the region near end 231) toward the second region (e.g., the region near end 232). In some embodiments, the capillary action in central passage 230 allows system 200 to lift water up the conduit without including a pump (e.g., pump 150 of system 100). In some embodiments (e.g., to provide both a decreasing cross-section for capillary lift as well as sufficient cross-sectional area for a specified flow capacity) the conduit can have an elongated cross-sectional shape (e.g., a high aspect-ratio rectangular shape, or that of a thin circular annulus).

As shown in FIG. 3C, in some embodiments, the cross-sectional area of gathering pore 210 decreases continuously from outer surface 220 to inner surface 225. As shown in FIG. 3D, the cross-sectional area of gathering pore 210 decreases in a stepwise manner from layer to layer (e.g., layers 235, 240, and 245) making up conduit 205.

Figure 3F:
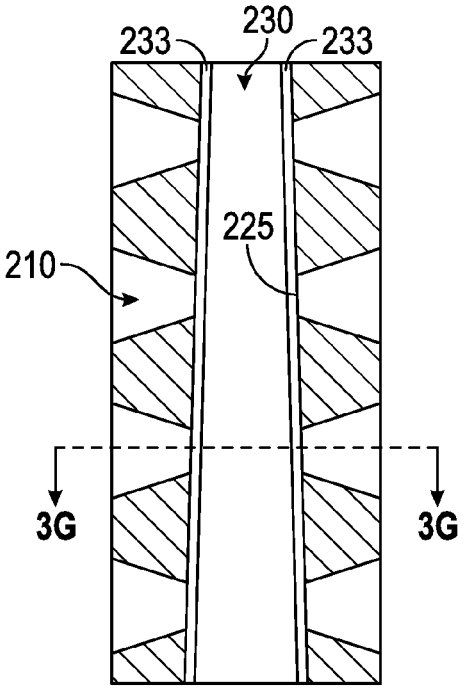
FIG. 3F is a cross-section view of the portion of the system of FIG. 2 along line 3-3, according to another embodiment.
Figure 3G:
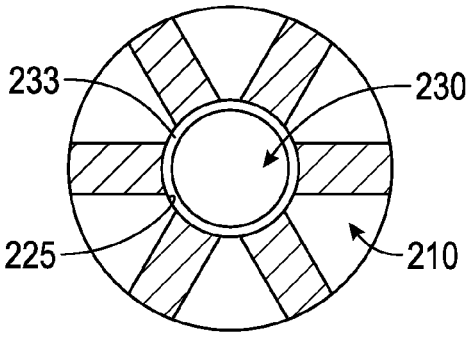
FIG. 3G is a cross-section view of the portion of the system of FIG. 3F along line 3G-3G.
Figure 3H:
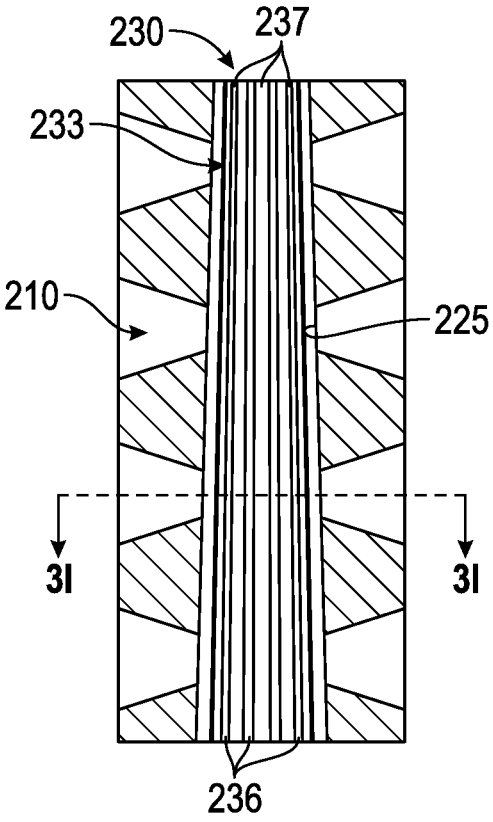
FIG. 3H is a cross-section view of the portion of the system of FIG. 2 along line 3-3, according to another embodiment.
Figure 3I:
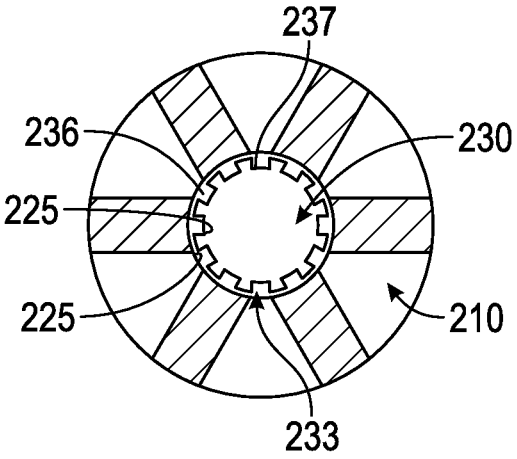
FIG. 3I is a cross-section view of the portion of the system of FIG. 3F along line 3I-3I.

As shown in FIGS. 3F-3I, in some embodiments, each conduit 205 of system 200 includes interior capillary structure 233 that extends from a first region of the conduit (e.g., the region near end 231) to a second region of the conduit (e.g. the region near end 232). As shown in FIGS. 3F and 3G, in some embodiments, capillary structure 233 comprises a wick lining inner surface 225 of conduit 205. As shown in FIGS. 3H and 3I, in some embodiments, capillary structure 233 comprises a grooved inner surface 225 including one or more grooves 236 alternating with landings 237. In some embodiments, a dimension (e.g., the width, the depth, etc.) of grooves 236 decreases from the first region of the conduit (e.g., the region near end 231) to the second region of the conduit (e.g., the region near end 232), providing a capillary gradient. Capillary structure 233 generally acts like similar capillary structures in heat pipes. Capillary structure 233 provides capillary action to move water in central passage 230 from the first region (e.g. the region near end 231) toward the second region (e.g., the region near end 232). In some embodiments, the capillary action in central passage 230 allows system 200 to lift water up the conduit without including a pump (e.g., pump 150 of system 100).

Figure 7:
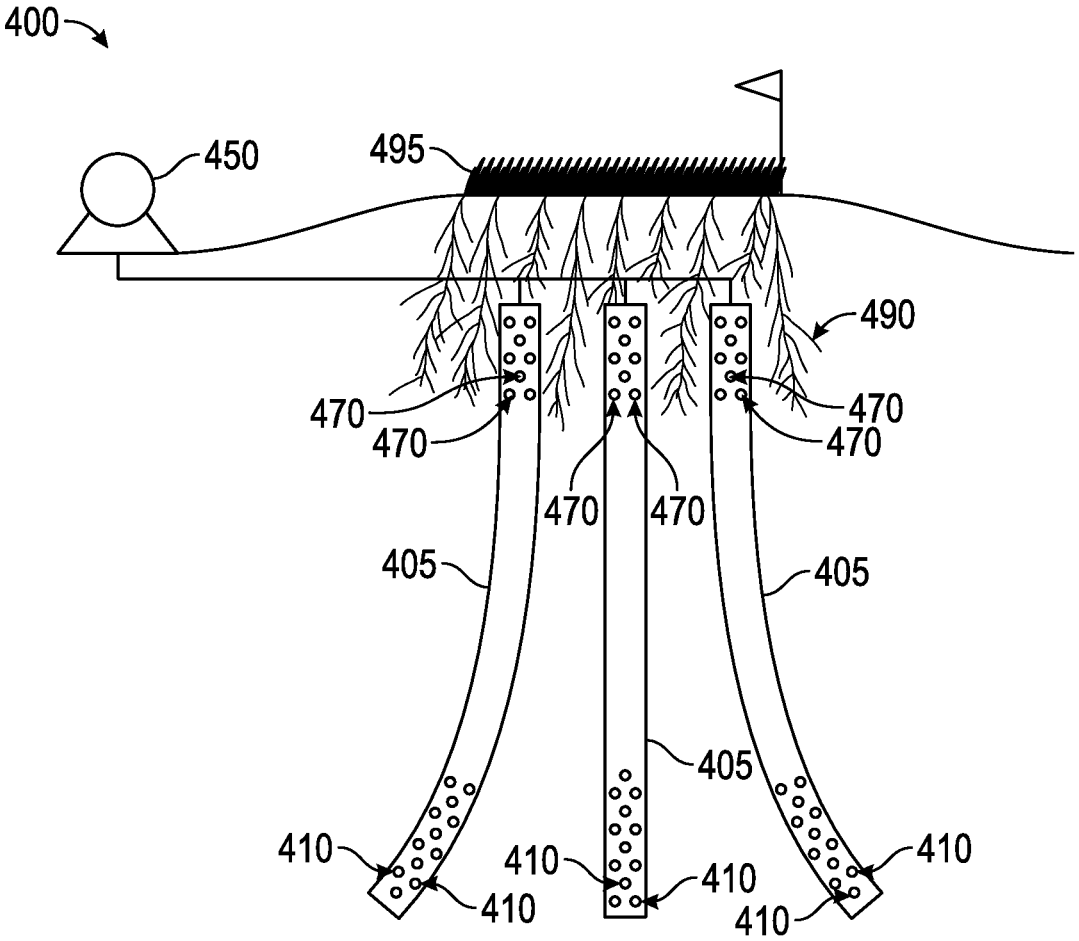
FIG. 7 is a schematic diagram of a system for gathering water from subsurface soil according to one embodiment.

As shown in FIG. 4, each conduit 205 includes delivery pores 270 extending through wall 215 from inner surface 225 to outer surface 220. Delivery pores 270 allow water to exit central passage 230 and conduit 205. Delivery pores 270 can be spaced apart from gathering pores 210. In some embodiments, delivery pores 270 are located within the region of the conduit near end 232 of conduit 205 (e.g., the top end) and gathering pores 210 are located within the region of the conduit near end 231 of conduit 205 (e.g., the bottom end). In some embodiments, as shown in FIG. 4, delivery pores 270 are located above ground and gathering pores 210 are located below ground. In some embodiments, delivery pores 270 deliver water at atmospheric pressure. In other embodiments (e.g., as shown in FIG. 7), delivery pores 270 are located below ground and gathering pores 210 are located below ground at a greater depth below ground than delivery pores 2740. As shown in FIG. 4, conduits 205 are positioned within container 265 so that water exiting delivery pores 270 is collected within the container. Delivery pores 270 may be formed in the same manner as gathering pores with a decreasing cross-sectional area from outer surface 220 to inner surface 225 (reversing the capillary head from the gathering pores) or with a constant or substantially constant cross-sectional area. In some embodiments, a pump may be used to create a driving pressure to facilitate delivery of water through the delivery pores out of the conduit. For example, a pump can be used to elevate the pressure inside the conduit, or to reduce pressure outside of the conduit, to create a pressure difference between the inside of the conduit and the outside of the conduit.

Figure 5:
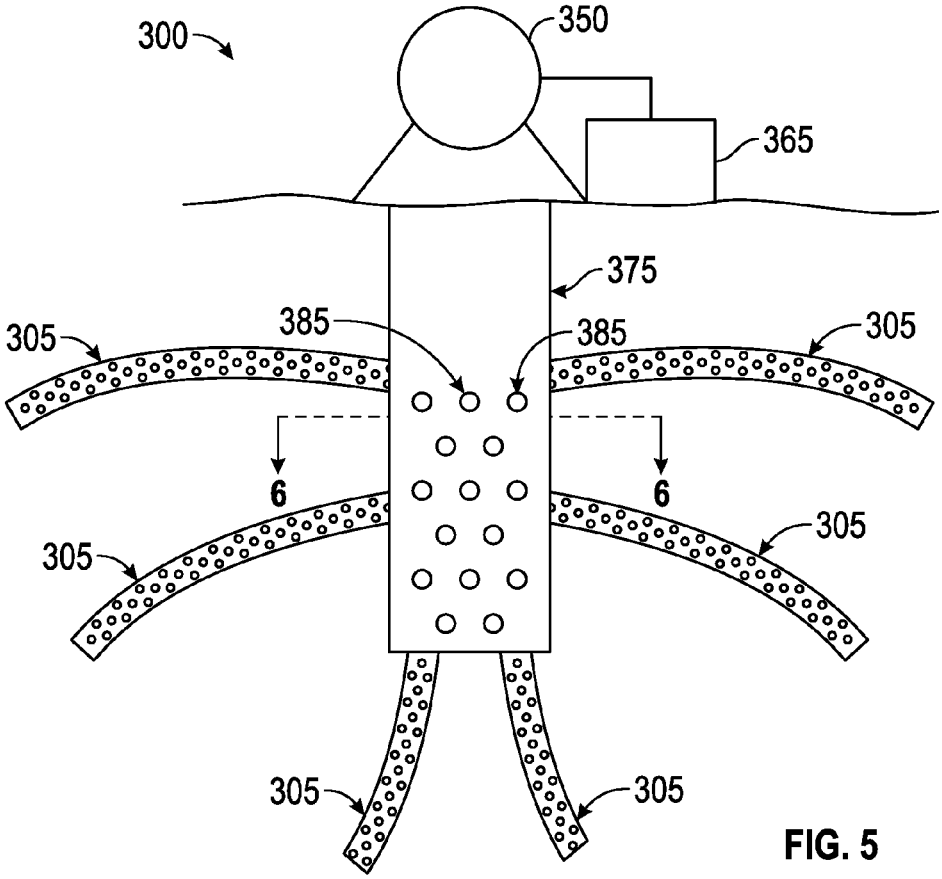
FIG. 5 is a schematic diagram of a system for gathering water from subsurface soil according to one embodiment.

Referring to FIG. 5, system 300 for gathering water from soil is illustrated according to one embodiment. System 300 is similar to system 100 and may include, in various embodiments, components similar to those described above with respect to system 100. Differences between system 300 and system 100 will be described in more detail below with components in system 300 similar to components in system 100 described by the same name and/or the same or similar reference number.

System 300 includes main conduit 375 similar to conduits 105. Conduits 305 extend from main conduit 375 with the central passages of conduits 305 fluidly coupled to central passage 380 of main conduit 375. Main conduit 375 functions as a "tap root" with water gathered by conduits 305 delivered to main conduit 375. System 300 may include one or more main conduits.

Figure 6:
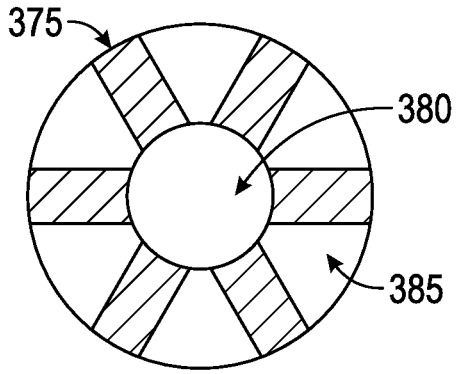
FIG. 6 is a cross-section view of a portion of the system of FIG. 5 along line 6-.

In some embodiments, as shown in FIG. 6, main conduit 375 includes gathering pores 385 similar to gathering pores 110. In other embodiments, main conduit 375 does not include gathering pores 385. The cross-sectional area of gathering pores 385 decreases in a manner similar to those described above with respect to FIGS. 3A-3D. In some embodiments, main conduit 375 includes delivery pores similar to delivery pores 270. Such delivery pores may be located above ground or below ground.

Central passage 380 is fluidly coupled to pump 350. Pump 350 delivers water gathered by conduits 305 and main conduit 375 to container 365. In some embodiments, the cross-sectional area of central passage 380 decreases in a manner similar to those described above with respect to FIGS. 3C-3D. In some embodiments, the capillary action promoted by the decreasing cross-sectional area of central passage 380 allows pump 350 to be omitted.

Referring to FIG. 7, system 400 for gathering water from soil is illustrated according to one embodiment. System 400 is similar to systems 100 and 200 and may include, in various embodiments, components similar to those described above with respect to systems 100 and 200. Differences between system 400 and systems 100 and 200 will be described in more detail below with components in system 400 similar to components in systems 100 and 200 described by the same name and/or the same or similar reference number.

System 400 is used to move water from a first depth below ground to a second shallower depth below ground. Such a system is useful for moving water in subsurface soil below root systems 490 of plants 495 (e.g., below root level) to the subsurface soil near the root systems (e.g. root level). The root level will vary based on the type of plant. As shown in FIG. 7, gathering pores 410 below root level gather water that is moved through conduits 405 to delivery pores 470 at root level. Pump 450 is fluidly coupled to conduits 405 (e.g., by a pipe, hose, or other appropriate conduit) to provide the necessary suction to move the gathered water through conduits 405.

System 400 facilitates gathering water below the root level for use at the root level. For example, a putting green is watered regularly. The water moves downward through the soil, where some is gathered by root systems 490 of grass 495 of the putting green. However, not all of this water is gathered by root systems 490. This water not gathered by roots systems 490 is gathered by system 400 below root level and returned to root level where it may be gathered by root systems 490.

System 400 helps to ensure that as much of the water used to irrigate the soil is actually gathered by the root systems of the grass. System 400 is particularly useful in locations (e.g., a putting green, yards, gardens, farms, etc.) where some of the water intended to irrigate plants may move below the root systems of the plants. System 400 also helps to control water usage for irrigation. Because water that eludes the root systems of the plants is gathered by system 400 and returned to root level, irrigation or watering may be performed less frequently saving on water usage. This can be particularly helpful in dry climates, during times of draught, for saving money on water usage, and in other situations where it is desirable to minimize water usage. In situations where there is more water by volume in the soil at root level than below root level, pump 450 may be operated to provide a positive pressure in conduits 405 to prevent water from entering conduits 405 through delivery pores 470.

Figure 8:
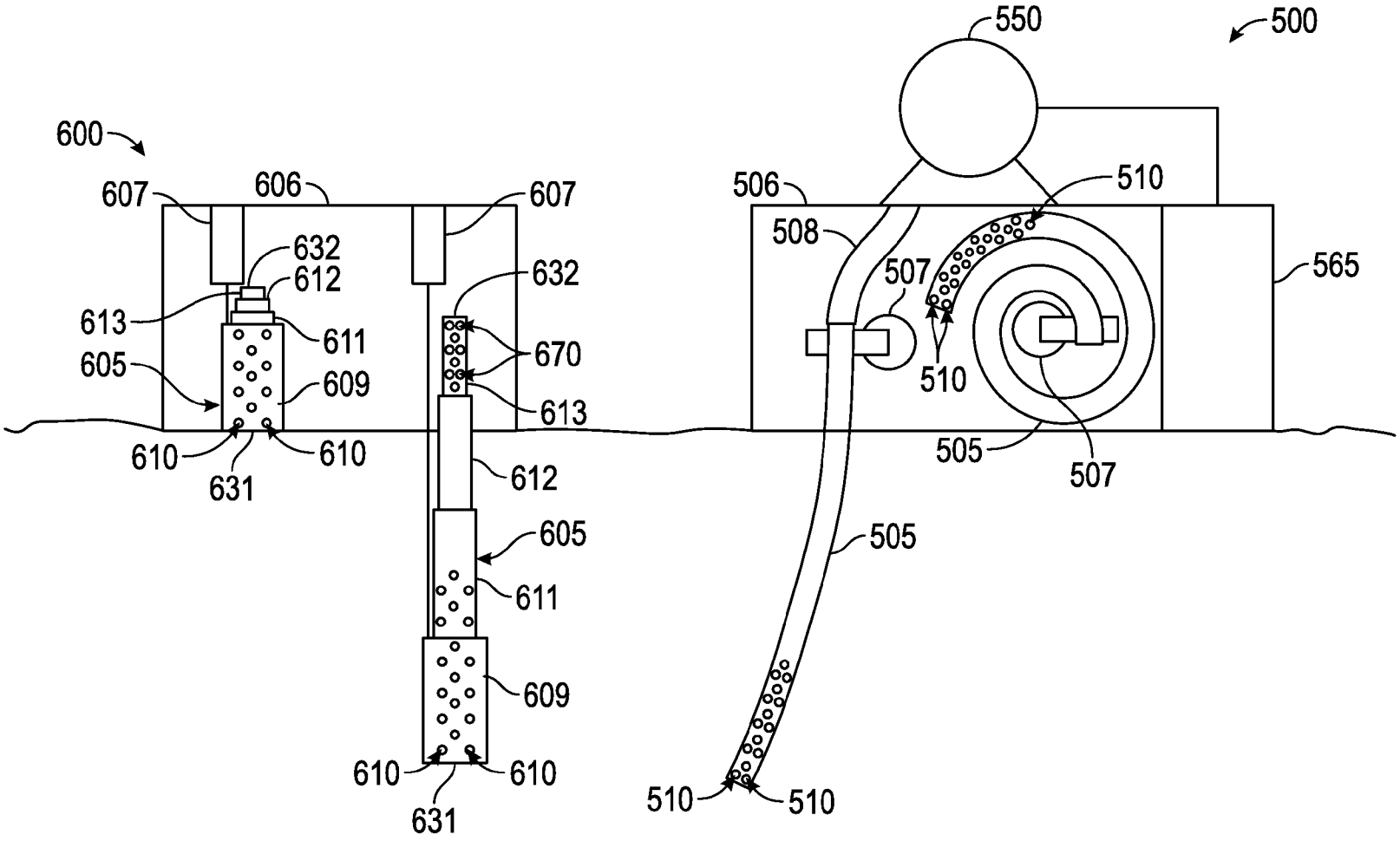
FIG. 8 is a schematic diagram of a system for gathering water from subsurface soil according to one embodiment.

Referring to FIG. 8, systems 500 and 600 for gathering water from soil are illustrated according to one embodiment. Systems 500 and 600 are similar to systems 100 and 200 and may include, in various embodiments, components similar to those described above with respect to systems 100 and 200. Differences between systems 500 and 600 and systems 100 and 200 will be described in more detail below with components in systems 500 and 600 similar to components in systems 100 and 200 described by the same name and/or the same or similar reference number.

Systems 500 and 600 include robotically or automatically deployed conduits 505 and 605, respectively. Conduits 505 and 605 are movable between a restricted position in which they are stored within storage case 506 or 606 and an extended position in which they are inserted into the soil when storage case 506 or 606 is positioned on or near the ground.

As shown in FIG. 8, in some embodiments of system 500, conduits 505 are coiled within storage case 506 when in the retracted position and are moved to the extended position by actuator 507 (e.g., an electric, hydraulic, or pneumatic motor or other appropriate actuator).

In some embodiments, system 500 includes pump 550. Conduits 505 may be directly fluidly coupled to pump 550 or indirectly fluidly coupled to pump 550 (e.g., by intermediate conduit 508). Pump 550 delivers gathered water to container 565. System 500 may also include a battery or other power supply (e.g., hydraulic or pneumatic storage tank, supercapacitor, fuel cell, etc.) for powering pump 550 and/or actuator 507. In some embodiments, system 500 includes one or more main conduits (e.g., similar to main conduit 375). In other embodiments, pump 150 is omitted and capillary action is used to move gathered water through conduits 505.

As shown in FIG. 8, in some embodiments of system 600, conduits 605 consist of telescoping segments (e.g., segments 609, 611, 612, and 613) that slide within one another and are moved between a retracted position within storage case 606 and an extended position by actuator 607 (e.g., electric linear actuator, pneumatic or hydraulic cylinder, or other appropriate actuator). Storage case 606 can also function as the container to which the gathered water is delivered (e.g., similar to container 265). In some embodiments, conduits 605 move the gathered water through capillary action from gathering pores 605 to delivery pores 670. For example, the cross-sectional area of the central passage of each telescoping segment can decrease in a stepwise fashion from segment 609 (including end 631) to segment 613 (including end 632) to promote capillary action.

In some embodiments, system 600 may also include a battery or other power supply (e.g., hydraulic or pneumatic storage tank, supercapacitor, fuel cell, etc.) for powering actuator 607. In some embodiments, system 600 includes one or more main conduits (e.g., similar to main conduit 375). In some embodiments, a pump (e.g., a pump similar to pump 550) is used in place of capillary action to move gathered water through conduits 605.

Figure 9:
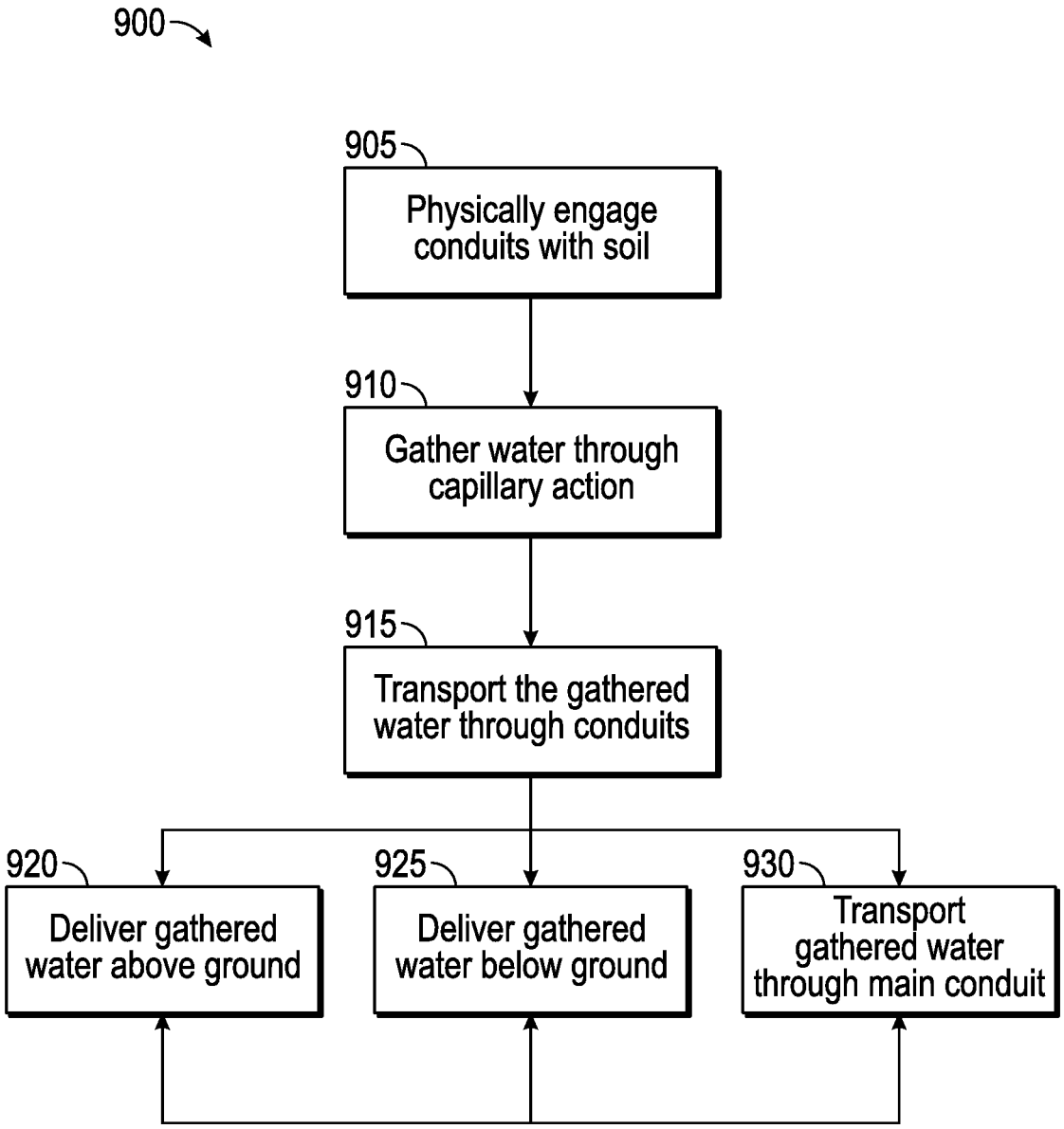
FIG. 9 is a flow chart of a method of gathering water from subsurface soil according to one embodiment.

Referring to FIG. 9, a method of gathering water 900 is illustrated according to one embodiment. In some embodiments, method 900 is implemented by one or more of systems 100, 200, 300, 400, 500, and 600. Conduits (e.g., conduits 105, 205, 305, 405, 505, 605) are physically engaged with soil (e.g., inserted below ground into soil and/or positioned along the ground in physical contact with the soil) (905). Water is gathered from soil into the conduits through gathering pores (e.g. gathering pores 110, 210, 310, 410, 510, 610) that promote capillary action (910). The gathered water is transported through the conduits (e.g., by capillary action or by suction) (915). The gathered water may be delivered above ground (e.g., by delivery pores 270, 670, by a pump 150, 350, 550, etc.) (920) or may be delivered below ground (e.g. by delivery pores 470 and pump 450, etc.) (925). The gathered water from the conduits may also be transported through a main conduit (930) prior to being delivered above ground (920) or below ground (925).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A conduit system for gathering water from soil, comprising:

a plurality of conduits configured for insertion into soil, each conduit including a wall having an outer surface configured to be exposed to soil and an inner surface defining a central passage, wherein the wall includes a plurality of gathering pores extending through the wall, and wherein the cross-sectional area of each gathering pore decreases from a first size at the outer surface to a minimum at an intermediate position along the pore, and then increases to a second size at the inner surface larger than the minimum to promote capillary action for moving water from the soil through each gathering pore to the central passage.

2. The conduit system of claim 1, further comprising a capillary structure within the conduit extending from a first region of the conduit to a second region of the conduit, wherein the capillary structure is configured to move water toward the second region.

3. The conduit system of claim 2, wherein the first region is near a first end of the conduit and the second region is near the opposite end of the conduit.

4. The conduit system of claim 2, wherein the capillary structure comprises a wick.

5. The conduit system of claim 2, wherein the capillary structure comprises one or more grooves in the inner surface.

6. The conduit system of claim 1, wherein each conduit extends from a first region to a second region and the cross-sectional area of the central passage decreases from the first region to the second region to promote capillary action for moving water toward the second region.

7. The conduit system of claim 6, wherein the first region is near a first end of the conduit and the second region is near the opposite end of the conduit.

8. The conduit system of claim 1, further comprising:

a pump fluidly coupled to the central passage of each conduit for moving water through each conduit.

9. The conduit system of claim 1, further comprising:

a main conduit including a main passage, wherein each conduit extends from the main conduit and each central passage is fluidly coupled to the main passage.

10. The conduit system of claim 1, wherein the cross-sectional areas of the gathering pores are sized so that water moving through the gathering pores is filtered.

11. The conduit system of claim 1, wherein each conduit further includes a plurality of delivery pores extending through the wall to deliver water from the central passage through the wall.

12. The conduit system of claim 11, wherein the delivery pores are located within a first region of the conduit and the gathering pores are located within a second region of the conduit.

13. The conduit system of claim 11, wherein the delivery pores are configured to be located above ground and the gathering pores are configured to be located below ground.

14. The conduit system of claim 11, wherein the delivery pores are configured to be located below ground and the gathering pores are configured to be located below ground at a greater depth below ground than the delivery pores.

15. The conduit system of claim 1, wherein the wall of each of the conduits comprises a plurality of layers.

16. The conduit system of claim 1, wherein the cross-sectional area of each gathering pore decreases continuously from the outer surface to the inner surface.

17. The conduit system of claim 1, wherein each of the conduits is configured to be automatically movable between a retracted position and an extended position in which the conduits are configured to be inserted into the soil.

18. The conduit system of claim 17, further comprising:

an actuator configured to move one or more of the conduits between the retracted position and the extended position.

19. A method of gathering water from soil, comprising:

inserting a plurality of conduits into soil, each conduit including a wall having an outer surface configured to be exposed to soil and an inner surface defining a central passage, wherein the wall includes a plurality of gathering pores extending through the wall, and wherein the cross-sectional area of each gathering pore decreases from a first size at the outer surface to a minimum at an intermediate position along the pore, and then increases to a second size at the inner surface larger than the minimum to promote capillary action for moving water from the soil through each gathering pore to the central passage;

gathering water into the conduits through the plurality of gathering pores;

transporting the gathered water through the conduits; and delivering the gathered water to a location above ground.

20. The method of claim 19, wherein transporting the gathered water through the conduit occurs through suction.

21. The method of claim 19, further comprising:

providing a main conduit from which each conduit extends; and transporting the gathered water from each of the conduits through the main conduit.

22. The method of claim 19, further comprising:

moving air through the conduits and out of the gathering pores to clean the gathering pores.

23. A conduit system for gathering water from soil, comprising:

a plurality of conduits configured for insertion into soil, each conduit including a wall having an outer surface configured to be exposed to soil and an inner surface defining a central passage, wherein the wall includes a plurality of gathering pores extending through the wall, and wherein the cross-sectional area of each gathering pore decreases from a first size at the outer surface to a minimum at an intermediate position along the pore, and then increases to a second size at the inner surface larger than the minimum to promote capillary action for moving water from the soil through each gathering pore to the central passage;

a means for transporting the gathered water through each conduit; and a means for automatically moving each of the conduits between a retracted position and an extended position.

24. The conduit system of claim 23, wherein the means for transporting the gathered water comprises a central passage in each conduit having a cross-sectional area that decreases from a first end of the conduit to a second end of the conduit to promote capillary action for moving water toward the second end.

25. The conduit system of claim 23, wherein the means for transporting the gathered water comprises a capillary structure in each conduit extending from a first region of the conduit to a second region of the conduit and configured to promote capillary action for moving water toward the second region.

26. The conduit system of claim 25, wherein the first region is near a first end of the conduit and the second region is near the opposite end of the conduit.

27. The conduit system of claim 23, wherein the means for transporting the gathered water comprises a central passage in each conduit and a pump fluidly coupled to the central passages for moving water through the conduits.

28. The conduit system of claim 23, wherein each conduit further includes a means for delivering water from each conduit.

29. The conduit system of claim 28, wherein the means for delivering water is spaced apart from the means for gathering water.

30. The conduit system of claim 23, further comprising:

a main conduit, wherein each conduit extends from the main conduit and the main conduit includes a means for transporting the gathered water through the main conduit.

31. The conduit system of claim 30, wherein the main conduit further includes a means for gathering water from soil through capillary action.

* * * * *